US005978966A

United States Patent [19]

Dicker et al.

[11] Patent Number: 5,978,966

[45] Date of Patent: Nov. 9, 1999

[54] ENERGY EXPENDITURE GARMENT

[76] Inventors: Timothy P. Dicker, 6906 Foothill Blvd., Tujunga, Calif. 91042-2780; William T. Wilkinson, P.O. Box 73, Salem, N.J. 08079

[21] Appl. No.: 09/151,840

[22] Filed: Sep. 11, 1998

[51] Int. Cl.[6] ..... A41B 1/00

[52] U.S. Cl. ..... 2/69; 2/227; 2/228; 2/115; 482/120; 450/104

[58] Field of Search ..... 2/69, 79, 228, 2/227, 238, 170, 108, 115, 102, 70, 455, 456; 482/105, 120, 121, 124, 131, 74; 450/104

[56] References Cited

U.S. PATENT DOCUMENTS

| | | |
|---|---|---|
| 1,178,165 | 8/1916 | Lupton . |
| 2,097,376 | 10/1937 | Marshman . |
| 2,613,932 | 10/1952 | Manners . |
| 2,664,566 | 1/1954 | Mianulli . |
| 3,411,500 | 11/1968 | Gatts . |
| 3,559,654 | 2/1971 | Pope . |
| 3,759,510 | 9/1973 | Jackson . |
| 4,065,814 | 1/1978 | Fox . |
| 4,220,299 | 9/1980 | Motter . |
| 4,325,379 | 4/1982 | Ozbey . |
| 4,384,369 | 5/1983 | Prince . |
| 4,625,336 | 12/1986 | Derderian . |
| 4,670,913 | 6/1987 | Morell . |
| 4,698,847 | 10/1987 | Yoshihara . |
| 4,850,056 | 7/1989 | Gardner et al. . |
| 4,910,802 | 3/1990 | Malloy . |
| 4,953,856 | 9/1990 | Fox . |
| 4,961,573 | 10/1990 | Wehrell . |
| 4,968,028 | 11/1990 | Wehrell . |
| 4,993,705 | 2/1991 | Tolle . |
| 5,033,123 | 7/1991 | Audet . |
| 5,046,194 | 9/1991 | Alaniz . |
| 5,060,315 | 10/1991 | Ewing . |
| 5,062,642 | 11/1991 | Berry . |
| 5,109,546 | 5/1992 | Dicker . |
| 5,141,223 | 8/1992 | Block . |
| 5,176,600 | 1/1993 | Wilkinson . |
| 5,186,701 | 2/1993 | Wilkinson . |
| 5,201,074 | 4/1993 | Dicker . |
| 5,203,754 | 4/1993 | MacLean . |
| 5,256,119 | 10/1993 | Tudor . |
| 5,263,916 | 11/1993 | Bobich . |
| 5,267,928 | 12/1993 | Barile . |
| 5,282,277 | 2/1994 | Onozawa . |
| 5,306,222 | 4/1994 | Wilkinson . |
| 5,308,305 | 5/1994 | Romney . |
| 5,336,139 | 8/1994 | Miller . |
| 5,357,637 | 10/1994 | Moore . |
| 5,367,708 | 11/1994 | Fujimoto . |
| 5,372,565 | 12/1994 | Burdenko . |
| 5,375,610 | 12/1994 | Lacourse . |
| 5,383,235 | 1/1995 | Peters . |
| 5,465,428 | 11/1995 | Earl . |
| 5,518,480 | 5/1996 | Frappier . |
| 5,518,481 | 5/1996 | Darkwah . |
| 5,570,472 | 11/1996 | Dicker . |
| 5,659,895 | 8/1997 | Ford, Jr. . |
| 5,737,772 | 4/1998 | Dicker et al. ..... 2/69 |
| 5,737,773 | 4/1998 | Dicker et al. ..... 2/69 |
| 5,819,322 | 10/1998 | Dicker et al. ..... 2/456 |

*Primary Examiner*—Gloria Hale

*Attorney, Agent, or Firm*—Connolly Buve Lodge & Hutz LLP

[57] ABSTRACT

An energy expenditure garment includes a body portion and limb portions made of a base fabric and incorporating at least one elastic resistance band which is free of any limb extremity anchor structure. The garment includes structure for retarding slippage of the garment during an exercise while still permitting some degree of slippage.

37 Claims, 2 Drawing Sheets

ENERGY EXPENDITURE GARMENT

BACKGROUND OF THE INVENTION

Various garments have been suggested which involve elastic elements to provide a resistance to an activity which would require the swinging or bending of the arms and/or legs and/or body. Generally, such elastic elements are elastic cords or bands which are separate from the remainder of the garment, but are otherwise attached to the garment or the elastic elements are in the form of elastic panels which are integral with the remainder of the garment. Examples of such garments described in patents are found in U.S. Pat. Nos. 5,109,546, 5,176,600, 5,186,701, 5,201,074, 5,306,222, 5,570,472, 5,700,231, 5,708,976, 5,727,254, 5,737,772, 5,737,773 and 5,745,917. Additional disclosures of such garments are found in various U.S. patent applications, namely, Ser. No. 08/834,887, filed Apr. 7, 1997, now U.S. Pat. No. 5,839,122; Ser. No. 08/840,917, filed Apr. 25, 1997, now U.S. Pat. No. 5,778,842; Ser. No. 08/880,715, filed Jun. 23, 1997, now U.S. Pat. No. 5,819,322; Ser. No. 08/892,669, filed Jul. 14, 1997, now U.S. Pat. No. 5,857,947; Ser. No. 08/922,256, filed Aug. 25, 1997, now U.S. Pat. No. 5,867,826; Ser. No. 08/929,945, filed Sep. 15, 1997, now U.S. Pat. No. 5,875,491 Ser. No. 08/944,517, filed Oct. 6, 1997, now U.S. Pat. No. 5,842,959 Ser. No. 08/962,721, filed Nov. 3, 1997, now U.S. Pat. No. 5,829,058; Ser. No. 08/975,450, filed Nov. 21, 1997, Ser. No. 08/986,521, filed Dec. 8, 1997 now U.S. Pat. No. 5,867,827; and Ser. No. 09/083,830, filed Mar. 12, 1998.

The general approach which has been previously taken is to anchor the elastic elements so as to assure that a resistance is required to stretch the anchored elements, such anchoring is usually in the form of some structure located at the limb extremity such as the wrist/hands and/or feet/ankles.

SUMMARY OF THE INVENTION

An object of this invention is to provide an energy expenditure garment of the above type which omits the known anchoring structure.

A further object of this invention is to provide such a garment wherein structure is incorporated to permit slippage of the garment and its elastic elements while, however, providing a retarding force.

In accordance with this invention an energy expenditure garment is provided which has elongated elastic elements, preferably in the form of bands which are integral with the main portion or basic fabric of the garment. The ends of the bands are not anchored to any specific anchoring structure at the limb extremities. As a result there can be some slippage or longitudinal movement of the elastic resistant elements during use of the garment. The garment however, includes structure to retard against completely free slippage.

THE DRAWINGS

DETAILED DESCRIPTION

Energy expenditure garments generally include some form of elastic element, such as an elastic cord or band, which offers greater resistance to a stretching movement and resistance to the elastic element returning to its original condition than does the base fabric. In order to maximize the benefits of such garments during stretching and training exercises, the conventional approach has been to anchor the ends of the elastic elements at the limb (arms/legs) extremities so as to minimize slippage of the garment thereby maximizing use of the elasticity characteristics which in turn maximizes the resistance that must be overcome and thus gives the maximum benefit of such elastic resistance elements. There are, however, certain types of exercise where it is not necessary to maximize the benefits of the elastic resistance elements, but where some of its benefits are still desired. For example, such resistance garments might be used for stretching/warm-up activities such as yoga, calisthenics, tai chi, gymnastics and for training in various martial arts sports, such as boxing, kick-boxing, wrestling, fencing and karate.

In accordance with this invention, specific anchor structure is not provided at the ends of these elastic resistance elements, such as in the hand/wrist areas or the ankle/foot areas. Preferably, no specific anchor structure is provided, instead, the garments are formed in such a manner as to permit slippage of the garment during the exercise, but retard the elastic resistance elements from complete or unrestricted slippage.

Such types of retarding structure could be to make use of compression or drag resistance such as by a cork screw pattern. The general drag or friction could result from the material itself, or from the fit of the material on the garment. Such drag can be either from the base material or from the elastic resistance bands or from a combination of both.

Structural characteristics could be used to provide the retarding effect at enlarged parts of the limbs, such as at the joint areas including the calf, waist, knees, thighs, hips, shoulders, elbow, ankles and forearm. An example of such structural characteristics would be a narrowing of the garment at those areas so that there would be a tendency to drag or snag the garment in the narrow area during sliding movement of the garment while the user performs the exercise. A further example of retarding could be from cuffs in the form of cuffs in the form of compression bands or friction rings.

The invention could be practiced with compression/tight fitting garments or with loose fitting garments such as sweat suits. Preferably the invention is practiced with such loose fitting garments which could be regular sweat suits, pants, shirts, tee-shirts, jerseys, etc. In this way, the traditional loose-fitting work-out garments could be modified by simply adding the resistance bands to produce an exercise, training, weight-loss, aerobic, strength and toning effect.

Figure 1:
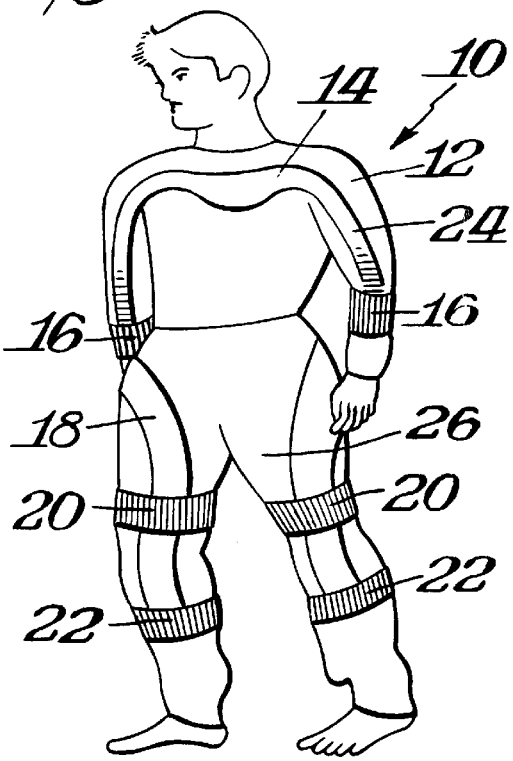
FIG. 1 is a front elevational view of an energy expenditure garment in accordance with this invention.

FIG. 1 illustrates an energy expenditure garment 10 which is constructed generally along the lines of the aforenoted patents and applications, all of the details of which are incorporated herein by reference thereto.

Garment 10 is made of a base fabric 12 which may be either loose fitting or tight fitting. Elastic resistance bands 14, 16, 18 and 22 are secured preferably as panels integral with base fabric 12 in any suitable manner as is disclosed in the aforenoted patent and applications. Garment 10 may be a one-piece suit or a two-piece suit. Garment 10 would include a upper body or shirt portion 24 and a pants portion 26.

Where garment 10 is a loose fitting garment, band 14 which extends across the front of the garment may be of, for example, 18% LYCRA. A similar band may be along the back of the garment. Where the base fabric itself is tight fitting, it is not necessary to have separate torso banding such as band 14, since the tight fitting base fabric itself may be of 18% lycra. Similarly, where the base fabric is tight fitting, the elastic resistance band 18 may also be omitted from the pants section. A general difference between the base fabric and the elastic resistance elements is that a greater force is required to stretch the elastic resistance elements and to restrain the elastic elements from returning to their original unstretched condition than would be required for the base fabric. Where there is no specific banding on the tight fitting base fabric, elastic resistance cuffs or friction rings 16, 16 will create resistance in the whole garment.

Each elastic resistance friction ring is preferably made with a plurality of raised ribs which are 27% nylon/lycra with the intermediate portions of the friction or compression rings being made of 18% nylon/lycra which is the same as the base fabric. Accordingly, the ribs are the elastic resistance elements which offer greater resistance than the intermediate sections of the friction or compression rings and more resistance than the base fabric.

Rings 20, 22 would have the same structure as rings 16 and could be provided at suitable locations on the legs remote from the ankles in the pants 26.

Figure 1A:
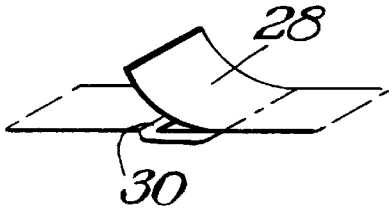
FIG. 1A is an enlarged view of a portion of the garment shown in FIG. 1.

FIG. 1A shows, in an enlarged view, an alternate structure which may be incorporated in the friction rings 16, 20, 22. In order to provide a tighter fit at the friction rings, each friction ring would include a flap 28 and a buckle 30 so that the circumference of each ring could be adjusted by being made larger or smaller.

Where bands 14, 18 are included, the bands may be secured to the various rings or may simply be secured at their ends to the base fabric. As illustrated however, there is no anchoring at the hand/wrist or feet/ankles as had been generally done. Instead, the pant legs or shirt sleeves are permitted to slide, but the sliding is retarded by the friction resulting from the compression rings or cuffs.

The retarding effect may be increased, particulary for a loose fitting garment by having the circumference of the garment reduced in a segment in the arms or legs particularly at or just outwardly of the elbows and knees or calf or forearm or thighs or wherever there is a widening of the limb so that the upward sliding movement of the garment which would result during the exercise would be resisted by the widened portion of the body in encountering a smaller diameter portion of the garment as the reduced diameter portion of the garment moves into contact with the enlarged portion of the limb. This could be accomplished by providing friction rings as illustrated, or by simply forming that portion of the garment at the widened portion of the limb of smaller diameter than its adjacent portions. The retarding could result from the enlarged body portion of the wearer without reducing the diameter of the garment. The portion of the garment which creates the retarding action when encountering the enlarged body portion could be elastic or non-elastic. The garment could have short sleeves or legs terminating above the wrists and above the ankles. The retarding action would result when the end of the sleeve slides up the forearm and the end of the leg slides up the calf. Similarly, the sleeves could terminate above the elbows and be retarded in movement toward the shoulders, while the legs could terminate above the knees and be retarded in movement up the thighs.

Figure 2:
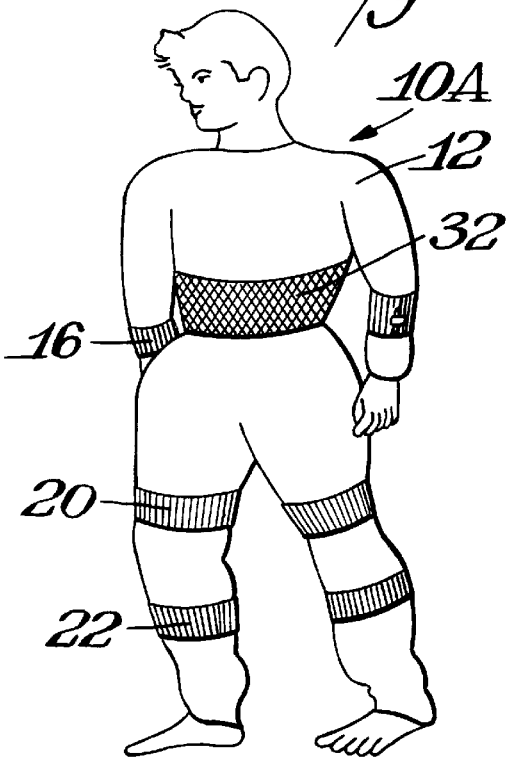
FIGS. 2–4 are front elevational views of various forms of energy expenditure garments in accordance with this invention.

FIG. 2 illustrates a garment 10A having base fabric 12 without any banding. Instead a plurality of compression rings 16, 20, 22 and 32 is provided. The base fabric preferably includes 18–22% lycra and is a tight fitting garment. Compression ring 32 is an abdominal compression ring with a lattice weave providing opposing resistance. The material used for ring 32 is preferably 27% lycra, thus offering greater resistance than the base fabric.

Figure 3:
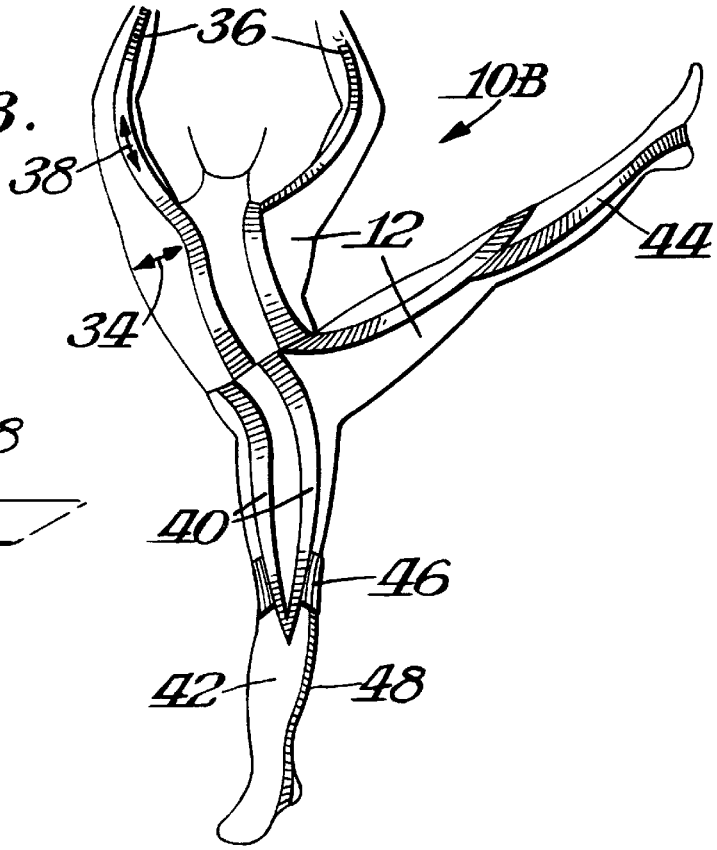

FIG. 3 illustrates a garment 10B which retards the movement of the elastic resistance bands without actually anchoring the bands. The retarding structure is based on the principle of using variable density material with different directional forces which causes the body to respond in a specific manner. Note is made of U.S. Pat. No. 5,700,231 and application Ser. No. 08/944,517, filed Oct. 6, 1997, now U.S. Pat. No. 5,842,959 all of the details of which are incorporated herein by reference thereto.

Garment 10B is preferably a tight fitting garment wherein the base fabric 12 is made of 18% nylon having a 2-way stretch in a transverse direction as illustrated by the double headed arrow 34. Longitudinal elastic bands 36 are made of 27% nylon having a 2-way stretch in the longitudinal direction as indicated by the double headed arrow 38. Bands 36 may extend completely along the arms to the torso and end at the torso with further bands continuing to the waist or a continuous band may extend from the arms to the waist, as illustrated. The pants portion would similarly have the base fabric 12 made of 18% nylon with 2 way transverse stretch, while the longitudinal bands 40 would be made of 27% nylon having 2-way longitudinal stretch. Preferably the material used in the leg portion 42 is made similar to a resistance band by having 2-way longitudinal stretch, but being made of an intermediate resistance material, such as 22% nylon.

FIG. 3 also illustrates that the invention could be practiced by combining anchored band elements with the retarding structure used for non-anchored elastic resistance elements. Thus FIG. 3 illustrates an elastic resistance band 44 to extend around the bottom of the feet where the band 44 would be anchored. FIG. 3 also illustrates a compression ring 46 extending partially around the leg and connected to a band 48 that could be anchored.

The lattice type structure used for abdominal ring 32 may also be used for various compression rings 16, 20, 22. Thus, when there is a longitudinal pulling of the garment during an exercise, as the garment tends to slip, the longitudinal pulling creates an increased compression effect to tighten the ring, thus retarding the slippage. This action is similar to the finger cots or "Chinese handcuffs" where a pulling causes the material to tighten.

Figure 4:
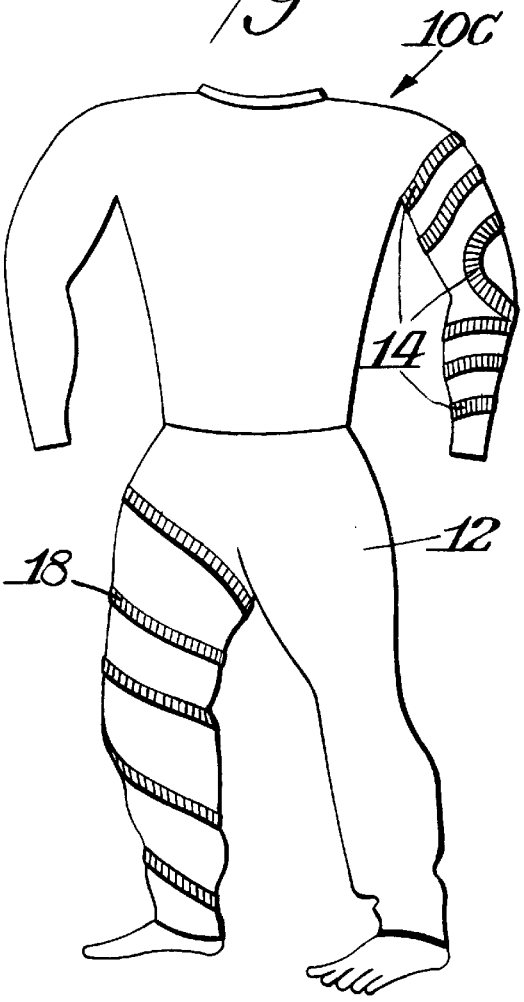

FIG. 4 shows a garment 10C which may be of one piece or two piece construction and which includes base fabric 12. The elastic resistance bands 14,18 extend in a spiral or corkscrew type manner rather than being completely elongated so as to increase the compression affect when there is a longitudinal pull on the garment during slippage thereby retarding the slippage.

Figure 5:
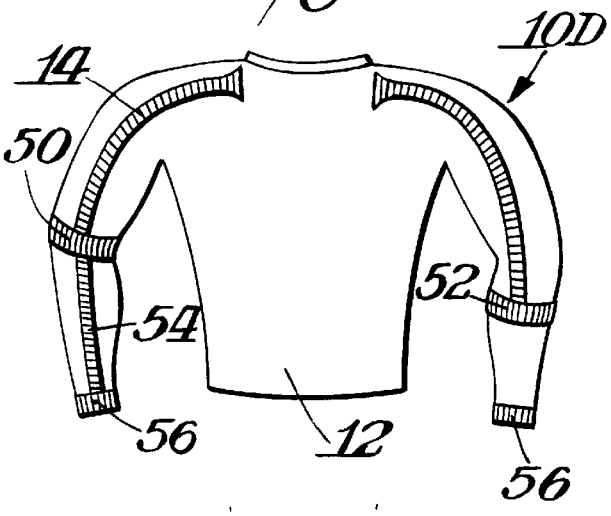
FIG. 5 is a front elevational view of a shirt or top portion of an energy expenditure garment in accordance with this invention.

FIG. 5 illustrates a garment 10D in the form of a shirt made of base fabric 12 and having elongated resistance bands 14 which extend down the arm sections of the garment. The diameter of the sleeve may be narrowed at or below the elbow. If desired, a compression cuff 50, 52 may be provided. For illustration purposes, cuff 50 is at the elbow while cuff 52 is at the forearm immediately below the elbow. Preferably, the garment would have both cuffs located at the same general portion of the arm. Where the cuffs 50, 52 are made of an elastic material, they are compression bands. The retarding effect can also be achieved with an inelastic cuff. Retarding of the slippage could be achieved without any cuff simply by virtue of the narrowed cross section in that region. Where a cuff is used which is made of lattice construction, it is not necessary to actually reduce the diameter of the cuff. Rather the cuff could be of the same dimension as its adjacent sections. Similarly, where a cuff is used, the cuff need not extend completely around the sleeve.

FIG. 5 also illustrates that the garment may include a further elastic band 54 which may be separate from or a continuation of band 14 and which extends to a wrist cuff 56. Wrist cuff 56 may be an elastic compression cuff or may be an inelastic cuff. Thus, FIG. 5 illustrates a wrist cuff used in the same garment as an elbow cuff. FIG. 5 also illustrates the same garment to include a wrist cuff 56 and a forearm cuff 52.

Figure 6:
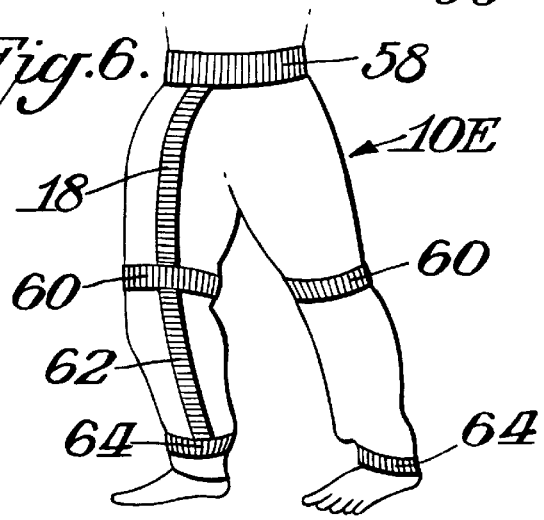
FIG. 6 is a front elevational view of a pants portion of an energy expenditure garment in accordance with this invention.

While FIG. 5 illustrates the garment in terms of a shirt, the same type of structure could be included in the pants where a knee or calf retarding structure is used, similar to the elbow and forearm structure. This is illustrated in FIG. 6 as shown therein pants 10E includes a resistance band 18 which extends from a waist band 58 to the retarding structure in the area of the knee. The retarding structure could be a narrowing of the cross sectional area of the leg at the knee, just above the knee in the thigh, or just below the knee in the calf. This narrowing could be in connection with a cuff 60 which could be an elastic compression band or an inelastic cuff. A further elongated band 62 could extend to a shin ring 64, just below the calf which would function in the same manner as cuff 60.

Preferably, the use of narrowing structure to cause retarding is incorporated in a loose fitting garment such as a sweat suit. The garment 10D which is the shirt portion, shown in FIG. 5, could be used with the garment 10E, which is the pants portion, to form a two-piece sweat suit or both pieces could be joined together to form a one-piece sweat suit with a suitable zipper or other attaching structure facilitating the user putting on and removing the sweat suit. The various narrowed area whether through use of a physical narrowing of the garment or through the location of a cuff in the area of an enlarged portion of the body or through the tightening affect by means of the lattice structure of the cuff would permit the garment to have some slippage yet retard the slippage so as to still gain the benefits of the elastic resistance elements.

What is claimed is:

1. An energy expenditure garment comprising a body portion and limb portions, each of said limb portions terminating in an extremity, said body portion being made of a base fabric, said limb portions being made of a base fabric, at least one elastic resistance element in said garment adjacent to said base fabric, said elastic resistance element being made of a material which requires a greater force to stretch said element and resist said element returning to its unstretched condition than the force required for said base fabric, said garment being free of limb extremity anchor structure for said elastic resistance element at said extremity, at least a portion of said extremity being made of a material which requires a lesser force to pull said limb portion upwardly than the force required to stretch said elastic resistance element whereby said garment at said elastic resistance element is free to move under slippage as a result of movement by the wearer, and retarding structure for offering resistance to said slippage while still permitting some slippage.

2. An energy expenditure garment comprising a body portion and limb portions, each of said limb portions terminating in an extremity, said body portion being made of a base fabric, said limb portions being made of a base fabric, at least one elastic resistance element in said garment secured to said base fabric, said elastic resistance element being made of a material which requires a greater force to stretch said element and resist said element returning to its unstretched condition than the force required for said base fabric, said garment being free of limb extremity anchor structure for said elastic resistance element at said extremity, said garment at said elastic resistance element being free to move under slippage as a result of movement by the wearer, retarding structure for offering resistance to said slippage while still permitting some slippage, said at least one elastic resistance element comprising a plurality of elastic resistance elements located in a friction ring in each of said limbs, and said resistance elements being in the form of ribs requiring a greater resistance force than the material of said rings intermediate said ribs.

3. The garment of claim 2 wherein said ribs are raised.

4. The garment of claim 3 wherein said garment includes a shirt portion having arms and a pants portion having legs, and said rings being in said arms and said legs of each of said shirt and pants portions.

5. The garment of claim 4 wherein elastic resistance bands interconnect sets of said rings.

6. The garment of claim 2 including adjusting structure for adjusting the circumference of said rings.

7. An energy expenditure garment comprising a body portion and limb portions, each of said limb portions terminating in an extremity, said body portion being made of a base fabric, said limb portions being made of a base fabric, at least one elastic resistance element in said garment secured to said base fabric, said elastic resistance element being made of a material which requires a greater force to stretch said element and resist said element returning to its unstretched condition than the force required for said base fabric, said garment being free of limb extremity anchor structure for said elastic resistance element at said extremity, said garment at said elastic resistance element being free to move under slippage as a result of movement by the wearer, retarding structure for offering resistance to said slippage while still permitting some slippage, said at least one elastic resistance elements including a plurality of elastic resistance elements incorporated in a ring, and said plurality of elastic resistance elements being disposed in a lattice weave to provide opposing resistance.

8. The garment of claim 7, wherein said ring is an abdominal ring.

9. The garment of claim 7, wherein said garment includes a shirt portion having arms and a pants portion having legs, and said rings being in each of said arms and each of said legs.

10. The garment of claim 1 wherein said at least one elastic resistance element includes a plurality of elastic resistance bands extending longitudinally of said garment, said base fabric being made of a two way stretch material which stretches in the transverse direction, and said bands being made of a two-way stretch material which stretches in the longitudinal direction.

11. The garment of claim 10, wherein said garment includes a shirt portion having arms and a pants portion having legs, and said elastic resistance bands being in said arms and said legs.

12. The garment of claim 1, wherein said at least one elastic resistance element is an elastic resistance band arranged on at least one of said limbs in a cork screw manner without being anchored to said limb extremity.

13. The garment of claim 12, wherein said cork screw elastic resistance band is provided on each of said limb portions.

14. The garment of claim 13, wherein said garment includes a shirt portion having arms and a pants portion having legs, and said elastic resistance bands being in each of said arms and said legs.

15. The garment of claim 1, wherein said retarding structure comprises a narrowing of said garment as compared to the cross-sectional area of said garment immediately adjacent to each side of said narrowing.

16. The garment of claim 1, wherein said at least one elastic resistance element is an elastic resistance band located on at least one of said limbs, and said retarding structure being structure for narrowing the limb in an area of the limb corresponding to a portion of the limb which is worn at or outwardly of an enlarged portion of the limb of the user.

17. The garment of claim 16, wherein said retarding structure includes a cuff extending at least partially around said limb at said narrowed location.

18. The garment of claim 17, wherein said garment is a shirt, and said cuff being located at the elbow of said shirt.

19. The garment of claim 17, wherein said garment is a shirt, and said cuff being located in the forearm portion of said shirt.

20. The garment of claim 16, wherein said garment is pants having legs with a knee portion for each leg, and said cuff being located at said knee portions of said legs.

21. The garment of claim 17, wherein said garment is pants having legs with a knee portion for each leg, and said cuff being located at a thigh portion of said pants immediately above said knee portion of said legs.

22. The garment of claim 17, wherein said garment is pants having legs with a knee portion for each leg, and said cuff being located below said knee portion and above a calf portion of said legs.

23. The garment of claim 17, wherein said garment includes a shirt portion and a pants portion, said shirt portion having arms and said pants portion having legs, and a set of said band and said cuff being located on each of said arms and said legs.

24. The garment of claim 17, wherein said cuff is made of an elastic material.

25. The garment of claim 17, wherein said cuff is made of an inelastic material.

26. The garment of claim 17, wherein said cuff forms a closed ring.

27. A method of wearing the garment of claim 1 wherein during limb movement in an exercise the garment slides up the limb and is retarded against unimpeded sliding movement by friction encountered as the garment slides on an enlarged portion of the limb.

28. The garment of claim 7 wherein said ring is a closed ring, and said ring being a compression ring.

29. In an energy expenditure garment comprising a body portion and limb portions, said garment including structure for providing at one zone of the garment greater force to stretch said one zone and resist said one zone returning to its unstretched condition than the force required for an adjacent second zone of the garment, the improvement being in that said garment includes at least three zones arranged so that each of said zones is adjacent to at least one of said other zones, each of said at least three zones each having a different degree of resistance than said other zones thereby requiring a different force to stretch said each of said zones and resist said each of said zones returning to its unstretched condition than the force for said other zones, one of said zones having the highest degree of resistance, a second of said zones having the lowest degree of resistance, and a third of said zones having an intermediate degree of resistance.

30. The garment of claim 29 wherein said garment is a suit having a shirt and pants, said shirt including said one zone and said second zone, and said pants including said one zone and said third zone.

31. The garment of claim 30 wherein at least one of said shirt and said pants includes each of said one zone and said second zone and said third zone.

32. The garment of claim 29 wherein each of said zones is made of different material secured together.

33. In an energy expenditure garment comprising a body portion and limb portions, each of said limb portions terminating in a limb extremity, said garment including a first zone and an adjacent second zone having different resistance characteristics in resisting a stretching of that zone, said first zone having a higher resistance characteristic than said second zone, the improvement being in that said first zone comprises a ring formed as a lattice weave providing opposing resistance wherein a longitudinal pulling creates increased compression which causes said ring to tighten.

34. The garment of claim 33 wherein said ring is a closed ring.

35. The garment of claim 33 wherein said ring is located inwardly of and remote from said limb extremity.

36. An energy expenditure garment comprising a body portion and limb portions, each of said limb portions terminating in an extremity, said body portion being made of a base fabric, said limb portions being made of a base fabric, at least one elastic resistance element in said garment secured to said base fabric, said elastic resistance element being made of a material which requires a greater force to stretch said element and resist said element returning to its unstretched condition than the force required for said base fabric, a joint portion on said limb portion about midway down said limb portion, a first compression ring at said extremity, a second compression ring generally at said joint portion, said elastic resistance element extending from said body portion down said limb portion to said second compression ring, and said elastic resistance element terminating at a location spaced from said first compression ring whereby there is no anchoring of said elastic resistance element to said first compression ring.

37. An energy expenditure garment comprising a suit having a shirt portion with arms and a pants portion with legs, each of said arms and each of said legs terminating in a limb extremity, said suit being made of a tight fitting material, said suit including a base fabric made of 2-way stretch material which stretches in a transverse direction, longitudinal elastic bands being connected to said base fabric, said longitudinal elastic bands being made of a 2-way stretch material which stretches in a longitudinal direction generally perpendicular to said transverse direction of said 2-way stretch of said base fabric, said longitudinal elastic bands being made of a material which requires a greater resistance force to stretch said longitudinal elastic bands and resist said longitudinal elastic bands returning to their unstretched condition than the resistance force required for said base fabric, and said base fabric of said pants being made of a material having a resistance force which is more than the resistance force of said base fabric of said shirt and less than the resistance force of said longitudinal elastic bands.

* * * * *